US007828004B2

(12) United States Patent
Rohde

(10) Patent No.: US 7,828,004 B2
(45) Date of Patent: Nov. 9, 2010

(54) METHOD AND DEVICE FOR STORING CHEMICAL PRODUCTS IN A CONTAINER

(76) Inventor: Uwe Rohde, Am Kreuzfeld 15, D-31595 Steyerberg (DE)

( * ) Notice: Subject to any disclaimer, the term of this patent is extended or adjusted under 35 U.S.C. 154(b) by 486 days.

(21) Appl. No.: 11/845,163

(22) Filed: Aug. 27, 2007

(65) Prior Publication Data

US 2009/0056814 A1 Mar. 5, 2009

(51) Int. Cl.
*B65D 88/74* (2006.01)

(52) U.S. Cl. ..... 137/13; 137/15.04; 137/334; 137/578; 137/590; 137/592

(58) Field of Classification Search ..... 137/1, 137/13, 240, 334, 339, 340, 341, 577, 578, 137/590, 592, 15.04
See application file for complete search history.

(56) References Cited

U.S. PATENT DOCUMENTS 2,224,403 A * 12/1940 Lines ..... 137/13
2,306,831 A * 12/1942 Proctor ..... 137/13
2,802,520 A * 8/1957 Trabilcy ..... 137/341
2,851,197 A * 9/1958 Colton ..... 222/146.5
3,662,781 A * 5/1972 Figliola et al. ..... 137/592
3,874,399 A * 4/1975 Ishihara ..... 137/13
3,906,973 A * 9/1975 De Jerphanion et al. ..... 137/13
3,969,608 A * 7/1976 Day ..... 137/341
4,230,138 A * 10/1980 Tanaka ..... 137/13
4,457,332 A * 7/1984 Hoshino et al. ..... 137/334
4,470,402 A * 9/1984 Tanaka ..... 137/340
4,592,491 A * 6/1986 Chollet ..... 222/146.5
4,987,922 A * 1/1991 Andrepont et al. ..... 137/592

(Continued)

FOREIGN PATENT DOCUMENTS

DE 534 084 C 1/1932

(Continued)

OTHER PUBLICATIONS

European Search Report issued inrelation to paralled European application on Apr. 15, 2008, pp. 1-2.

*Primary Examiner*—John Rivell
(74) *Attorney, Agent, or Firm*—Whitham Curtis Christofferson & Cook, PC

(57) ABSTRACT

In a method for the storage of chemical products in a container (1), the product is stored in the pertinent device in the liquid state with a temperature above its melting temperature and remains there at a lower environmental temperature, in an at least partly rigidified state until it is removed from storage. The product is evacuated from the device at the end of the storage phase in the following manner: Liquid product, coming from the production phase or conveyed in a cycle, is fed into the container (1) via an essentially vertical feeder line (5) consisting of heat conducting material and is distributed below at least one melting member (3; 8), consisting of heat conducting material, essentially horizontally over the cross-section of container (1), or by the heat content of the liquid product, in combination with the heat conductivities of the feeder line (5) and the melting member (3; 8), is used for melting product located in container (1), and whether product is evacuated by at least one horizontal flow level below the melting member or the melting members (3; 8) and vertically along the feeder line (5).

21 Claims, 8 Drawing Sheets

U.S. PATENT DOCUMENTS

| | | | | | |
|---|---|---|---|---|---|
| 5,069,244 | A | * | 12/1991 | Miyazaki et al. | 137/240 |
| 5,078,799 | A | * | 1/1992 | Matter et al. | 137/13 |
| 5,085,242 | A | * | 2/1992 | Ripley et al. | 137/13 |
| 5,176,161 | A | * | 1/1993 | Peters et al. | 137/590 |
| 5,197,513 | A | * | 3/1993 | Todd et al. | 137/592 |
| 5,320,161 | A | * | 6/1994 | Iiams | 137/340 |
| 5,381,860 | A | * | 1/1995 | Mather | 137/592 |
| 5,651,386 | A | * | 7/1997 | Nir | 137/340 |
| 6,568,415 | B2 | * | 5/2003 | Nakahara et al. | 137/1 |
| 6,915,818 | B2 | * | 7/2005 | Burris et al. | 137/590 |
| 7,188,639 | B2 | * | 3/2007 | Yada et al. | 137/340 |
| 2003/0131885 | A1 | * | 7/2003 | Birtcher et al. | 137/240 |
| 2004/0261851 | A1 | * | 12/2004 | Yada et al. | 137/334 |

FOREIGN PATENT DOCUMENTS

| | | | |
|---|---|---|---|
| DE | 83 31 135 | U1 | 12/1983 |
| EP | 0 134 741 | A | 3/1985 |
| GB | 2 132 164 | A | 7/1984 |

* cited by examiner

METHOD AND DEVICE FOR STORING CHEMICAL PRODUCTS IN A CONTAINER

This invention relates to a method and a device for the storage of chemical products in a container for chemical substances that are to be transported and further processed in a liquid form but that have a melting point that is above the desired or customary storage temperature.

These substances can be best stored in heated containers because removal from storage and insertion for storage will then not create any difficulties. Of course, this calls for high energy expenditures to maintain sustained heating. Besides, it is disadvantageous that the possibly occurring aging reactions and undesirable reactions with impurities will be accelerated at higher temperature.

When these substances are stored over longer periods of time, it is better in terms of energy to store the product in a solid or rigidified form and then to liquefy a part that is to be taken out.

The problem thus described for example is encountered during the storage of heavy oil that is viscous at environmental temperature and that can become completely solidified in cold regions and in the winter. Various devices have been developed for the storage of heavy oil; they facilitate storage in the at least partially solidified state.

DE 534084 discloses a storage container with a device for suctioning a viscous fluid where a heatable catch hood is arranged in the container so as to heat a part of the viscous fluid in a specifically targeted manner and to make it more liquid for removal. The method featuring the described device is suitable only for viscous fluids but not for completely solidifying substances because the solidified solid substance could not continue to flow under the hood.

DE 2432955 now discloses a method for the underground storage of heavy products, such as heavy oil, that rigidify at ordinary temperatures, where the surface of the rigidified product is placed in contact with at least one circulating warm fluid and where the liquefying product is pumped out. The method is designed for underground galleries and requires relatively much pumping work so as to wash away the stored product with the help of the warm fluid that constantly flows past. This requires all the more work when a crystallizing product with a high melting heat is stored. Heavy oil is to be thus washed out with water but that procedure is not suitable for all products.

Furthermore, DE 83 31 135 U1, discloses an asphalt container where a vertical pipe is arranged in the container; the feeder line empties into the open upper end of that pipe and the lower end of that pipe is arranged at a distance above the bottom of the container. If fresh, hot asphalt is poured from above into the vertical pipe, then, according to the principle of communicating pipes, the fresh, hot asphalt is stored in the container from bottom upward. At the end of the filling phase, there is, accordingly, in the lower end of the container, fresh, hot asphalt as a result of which the asphalt container, after filling, is immediately ready for operation over a certain span of time without any outside heating.

The known devices and methods are not suitable or are only poorly suitable for the storage of very fast rigidifying products, such as, for example, for organic-chemical products that are solidified within a narrow crystallization range. For example, dimethylterephthalate (DMT, $C_{10}H_{10}O_4$) is supplied in a liquid state with a melting range of 140.6° C. for the artificial fiber industry and accordingly is put up for intermediate storage in a liquid state from the very beginning. This has been done so far with a high energy expenditure in heated containers.

The object of the invention is to provide a method and a device for the storage of chemical products in a container which will make it possible, in a liquid fashion, to insert and remove quickly rigidifying products while a part of the product, stored in the container, is in the solid state.

To solve this problem, the invention proposes a method for the storage of chemical products in a container, where the product is inserted for storage in the liquid state with a temperature above its melting temperature and where it remains, at lower environmental temperature, in an at least partly rigidified state until it is removed from storage.

The invention-based process is distinguished by the fact that the evacuation of the product from the container takes place at the end of storage in such a manner that the liquid product, coming out of the production process or being piped in a cycle, will be fed into the container via an essentially vertical feed flow consisting of heat-conducting material and where said product is distributed essentially horizontally over the cross-section of the container below at least one melting member consisting of heat-conducting material, whereby the heat content of the liquid product, in combination with the heat conductivities of the feed line and the melting member or the melting members, is used for melting the product located in the container, and where the product is evacuated via at least one horizontal flow level below the melting member or the melting members and vertically along the feed flow.

The container can in particular be a tank, that is to say, a storage container that is generally supplied with an inlet and an outlet, also having a large volume, with a storage volume of more than 1 $m^3$ (one cubic meter), preferably more than 5 $m^3$.

As part of an advantageous development of the invention, the inlet and possibly additionally the surface below the melting member is blown clear after the passage of liquid product and is filled with a gas until the next use. The introduced gases should be product-friendly (inert) and should be as easily compressible as possible. Air, nitrogen, $CO_2$, or inert gases can be suitable, depending on the product involved.

With the help of an internal partition heating unit, provided on at least one outer wall of the container, one can generate additional liquid product outside a core of rigidified product that is stored below the melting point. The product, that is liquefied on the outer wall, can then be used for the melting of additional product that is to be evacuated or, during insertion for storage, it is used to adjust the pressure during storage insertion so as to guarantee a safe pressure adjustment, that is to say, to protect the container walls and accessories. When, during certain phases of storage insertion or removal or, quite generally, product is kept in a liquid state along the feed line and below at least one melting member, then, reusing the internal partition heating unit, one can generate an approximately ring-shaped core, enveloped by liquid product, said core consisting of rigidified product; this core then facilitates the turbulent allaround mixing of existing product.

Preferably, the product, that is melted along the internal partition heating unit, can be evacuated in vertical ducts which, for instance, can be formed with the help of the heat exchanger that is arranged on the interior wall for interior wall heating.

The method can be so implemented that the stored liquid product can on the whole be left to rigidify in the container. In that case, the feed line is kept clear by gas during the rigidification or crystallization process; this gas is piped in through the feed after the liquid product. Depending on the filling level—that is to say, especially if the filling level is at a maximum or near maximum—the underside of the (upper) melting member can be kept clear by gas or by blowing it clear.

As an alternative, the method however can also be implemented in the following manner: a part of the product, that is stored in the container, can be kept liquid by heating via heating elements, in particular, the interior partition heating unit and/or the feed and/or the melting member during the storage procedure. (Because the feed and the melting member according to the invention consist of heat conducting material, they can be easily heated).

A part of the product for the melting of rigidified product can preferably be conducted in a cycle via an additional, heated accessory container that is connected with the container. In one particular embodiment of the invention, the product can also be conveyed in a cycle within the container. For this purpose, for example, bottom heating can be provided additionally along with the outer wall heating.

The melting takes place especially by means of progressing liquefaction from the top to the bottom and/or from the bottom to the top, preferably while moving the melting members accordingly.

Particularly for the performance of the above-described method, the invention for the purpose of solving the problem furthermore provides a device for the storage of those chemical products that have a melting point below the storage temperature range, within a container that comprises the following elements:

- a container,
- a feed line—extending essentially vertically inside the container—for liquid product and gas, consisting of heat conducting material
- at least one melting member—extending essentially horizontally over the cross-section of the container—consisting of heat conducting material, which is arranged around the inlet and which is used for conducting and distributing the supplied liquid product,
- at least one outlet.

The outlet as well as the inlet can be provided with a valve at the entrance of the feed line.

The melting member is preferably arranged in a movable manner along the feed line, something that facilitates the gradual melting from the top to bottom or from the bottom to the top.

As part of a specially preferred embodiment, the feed line is made as a telescoping pipe. In all of its embodiments, the container is preferably at least partly cylindrical and the feed line is located along the axis of the cylinder. As an alternate model, the container or tank can also have a square or rectangular cross-section; in all of the embodiments, the feed line is preferably in a central position. The melting member can then preferably comprise an upper melting member which has a hat-like shape and which is arranged at the end of the feed line: in an advantageous embodiment of the invention, the upper melting member is provided with floats, preferably in the shape of a floating ring. The floating ring can retain the upper melting member at a certain level below or at the product level. The melting member can be adjusted in such a manner that it will dip higher or lower, in that the floating ring is filled exclusively with gas or partly with gas and partly with fluid or a suitable medium. The floating ring can also be used for heat supplied in that, for instance, a heating element is provided in a chamber of the floating ring.

As a development of the invention, the melting member additionally comprises a lower melting member that preferably extends in a ring-shaped manner around the feed line in the lower third of the container.

The melting member or the melting members can also have downward pointing accessories in the form of flow resistances. These flow resistances are used to distribute the liquid product uniformly underneath the particular melting member. This is also done by partial banking and swirling.

On at least one outer wall one can additionally provide an internal partition heating unit, preferably on a cylindrical outer wall. Ducts for the evacuation of product (generally downward) can be worked into the internal wall heating. Duct melting prevents damage to the container as a result of heat expansion because the escape of the developing forces is always ensured and because the container thus is not stressed mechanically. If, on the device, there are provided ducts along the outer wall, especially with separate, vertical heating possibility, then the process can be carried out in the following manner: first of all, vertical ducts are melted into the rigidified product and then a cross-section surface is melted clear below a melting member. The melting material resulting from horizontal melting can then flow off via the previously formed vertical ducts.

The interior partition heating unit preferably extends higher than the maximum filling level of the product in the container so that the entire internal wall surface can be kept clear of rigidified product. Guide elements can be provided on the upper melting member and they engage on the internal partition wall heating unit in a suitable manner and ensure a continuous and geometrically clearly determined melting zone.

To check the filling level and the storage condition of the product, measurement sensors can be provided, preferably on the melting member or on the melting members and/or on the outer wall.

Using a suitable measurement method, one can also determine whether and how much product is present and whether there is a gas phase below the melting member.

By way of a spatial arrangement with respect to the outlet of the feedline, one can provide an asymmetrical insert whose position can be altered and which for instance has the shape of a guide plate, by means of which one can impart to the product a certain preferential direction in the course of its distribution, during the storage insertion or removal phase. In case of detached containers, that can make it possible to balance temperature differences via the container cross-section. In colder regions, more hot liquid product is introduced with the help of the distribution insert so that the rigidified stored product can be melted uniformly.

The container can be made up of several parts. In particular, melting members, feed line and outlet line can be arranged on a bottomless container cap that, for instance, is set upon a lidless barrel so that, on the whole, one gets a bipartite container according to the invention. The outlet is placed either in the lower area (for example, the lower fifth) of the barrel or it is placed preferably additionally on the container cap, whence the stored, molten product can be suctioned off.

The invention will be explained below with reference to the exemplary embodiments illustrated in the drawing.

The figures are:

FIGS. 1,4 diagram illustrating a longitudinal profile through the storage container in an exemplary embodiment.

FIG. 1*a*, diagram illustrating exemplary embodiments of 1*b*, 1*c*, 1*d* melting members, looking from top or from bottom.

FIG. 2 diagram illustrating the storage container from FIG. 1 with additional melting member arranged near the bottom.

FIG. 2*a*, diagram illustrating an internal partition 2*b* heating unit for block-shaped containers (lateral profiles).

FIG. 3 diagram illustrating the storage container from FIG. 2 in the emptied state (longitudinal profile).

FIG. 5, 6 diagram illustrating the storage container from FIG. 2 with additional distribution insert (longitudinal profile).

FIG. 7 diagram illustrating a cut-out between the outer wall and the melting member.

FIG. 8 diagram illustrating a profile view of a cap container set upon a barrel (longitudinal profile).

Container 1 is a container suitable for the product, especially with a cylindrical or block-shaped design and has the following main components:

The interior partition heating unit 2*a* on the outer wall 2 of the container must be aligned along the expected forces, the necessary heat output, as well as in terms of the mechanical and hydraulic effect.

The upper melting member 3 can be a platform with a cylinder (hat 3*a*) that is aligned centrally upward, as well as with guide plates 10 arranged on the underside (accessories, flow resistances) and a closing edge 6 (guide rails).

The floats 4 can be made in the form of a floating ring and constitute a part on the upper melting member 3. Other floats or a divided design are possible. Preferably, floating ring 4 is suspended between hat 3*a* and edge 6 of the upper melting member on adjustable connections (cables).

Feed line 5 can be a telescoping pipe that is extended automatically or, alternatively, that is controlled by a motor, by the buoyancy of the floating rings 4 on the upper melting member 3. The telescoping pipe or the feeder line is possibly connected with the distribution accessory 9 so that the product can be guided in a particular fashion. Otherwise, the product is introduced preferably centrally via the telescoping pipe. Guide rails 6 are attached to the upper melting member 3 and ensure the interval between the upper melting member 3 and the interior wall heating unit 2*a*. Interior wall heating unit 2*a* can protrude beyond the guide rails 6 by a certain number of heating elements.

The filling and evacuation pipe 7 can be a quarter pipe that is welded upon the bottom around the feeder line 5, with openings for uniform heat distribution in the direction toward the container bottom. Filling and evacuation pipe 7 can be heated via a separate heating coil or via the heat of the feeder line 5.

The lower melting member 8 can be provided with outlet valves that release the flow if the product is evacuated under them or if the pressure above them is greater.

Distribution accessory 9 is moved with a drive in the particular position determined by the personnel or by the process control system.

Accessories 10, in the shape of guide plates 10 on the underside of melting members 3, 8, are used as flow resistances for the distribution and swirling of liquid product.

Measurement sensors 11 and contact makers are used to monitor the filling level and the storage condition of the product.

Floats 12 are used to determine what the distance is between melting members 3, 8 and the product, that is to say, whether or not gas has to be supplied.

FIG. 1 shows a (storage) container that is generally labeled 1, in this case a cylindrical, basin-shaped container, standing on a cylindrical bottom surface, with an oblique roof. Attached to the cylindrical outer wall 2 is the internal wall heating unit 2*a* which in this case practically covers the entire generated surface of the cylinder. A telescoping pipe protrudes centrally from the bottom of container 1, acting as feeder line 5 for liquid, as yet still hot product being piped into the container—in this case, illustrated in the fully extended state. At the upper end of feeder line 5 there is arranged a plate-shaped upper melting member 3 that is arched over the feeder line 5 with a hat-shaped middle part (hat) 3*a*. Spacers for the melting member 3 can be provided—for example, in the form of a screen plate (not shown here)—at the upper end of feeder line 5. Melting member 3 is provided with floats 4, in this case, in the shape of a floating ring. Floating ring 4 is moved by radially extending cables, reaching from hat 3*a* all the way to the edge of melting member 3, as shown in FIG. 1*a*. FIG. 1*a* shows a top view of the melting member with the float 4. FIG. 1*d* shows a similar variant for a container with a square cross section. Floating ring 4 is subdivided into several segments or individual floats. Guide rails 6 are provided on the edge of the upper melting member 3; they provide guidance with relation to the interior wall heating unit 2*a*. Finally, there are several guide plates 10 (accessories 10 pointing downward from melting member 3), which ensure uniform distribution of the product. Accessories 10 can have a special design as shown in FIG. 1*b* and especially 1*c* for special models. FIGS. 1*b* and 1*c* show variants of the melting members 3, from underneath. These embodiments are possible by the same token for the lower melting members 8 that are described below.

FIG. 2 shows a container 1 similar to the one shown in FIG. 1, except that, in the lower area of the container, near the bottom, there is additionally arranged a plate-shaped lower melting member 8 around the feeder line 5. Drainage valves can be provided on the lower melting member 8, as was explained earlier. FIG. 2 also shows how the floats can hold the melting member 3 with relation to the surface of the product located in container 1. The surface is labeled A. The floats 4 (floating ring) can, as indicated here, be partly filled with liquid, in order to be able precisely to adjust the height of the melting member, that is to say, the latter's relative position with respect to the product level.

FIG. 2*a* shows a possible embodiment of the internal partition heating unit 2*a*. Vertical ducts 2*b* are made in the heat exchanger that is provided for the wall heating and these ducts are used for the perpendicular evacuation of the liquefied product in the direction toward the bottom.

FIG. 2*b* shows a corresponding wall heating unit, similar to the one in FIG. 2*a*, for a container with a square cross-section. The product can be taken out there via outlets near the edge or centrally in the vicinity of the feeder line if a lower melting member keeps the bottom area in the molten state.

Figure 1:
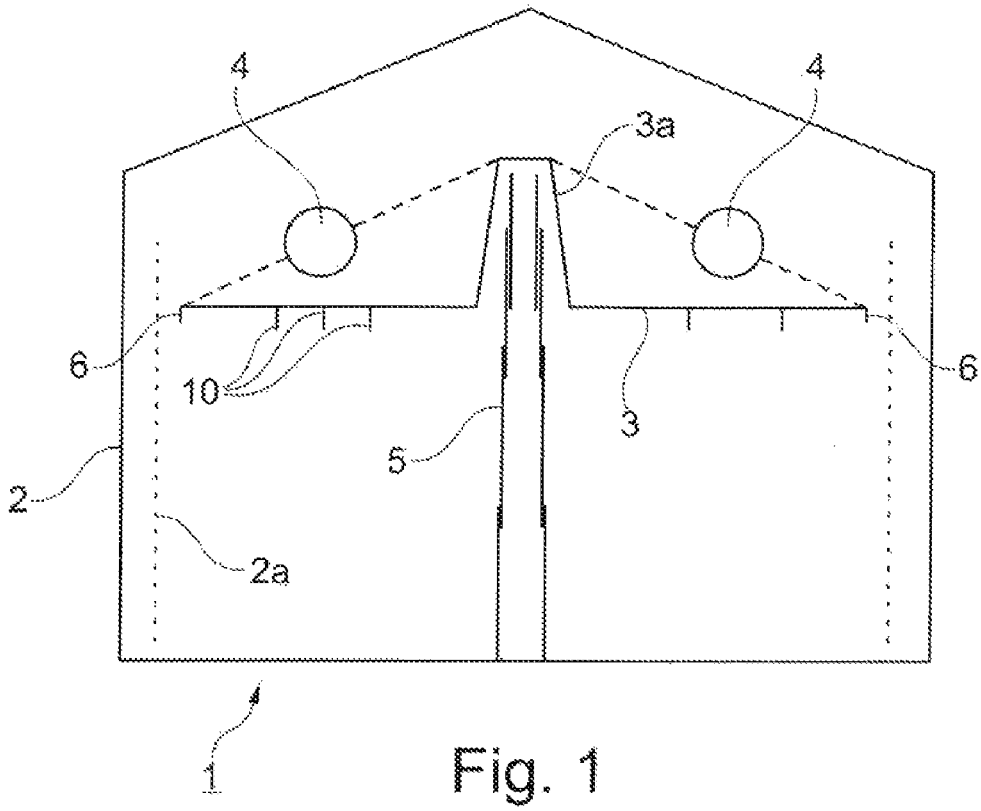
Figure 1A:
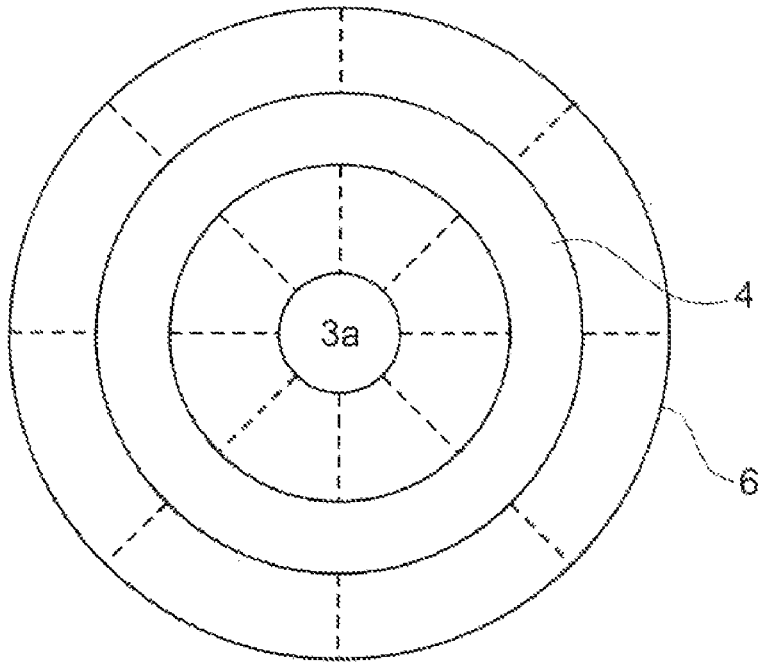
Figure 1B:
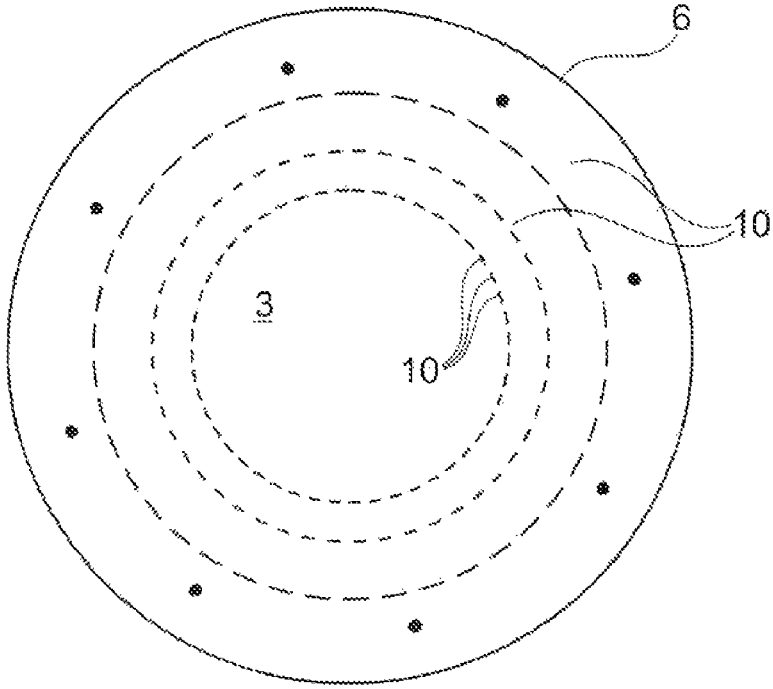
Figure 1C:
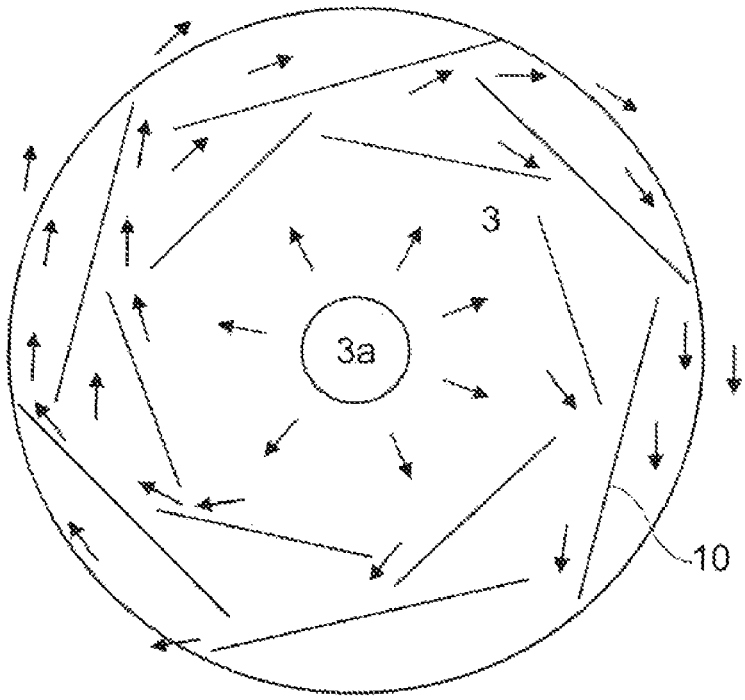
Figure 1D:
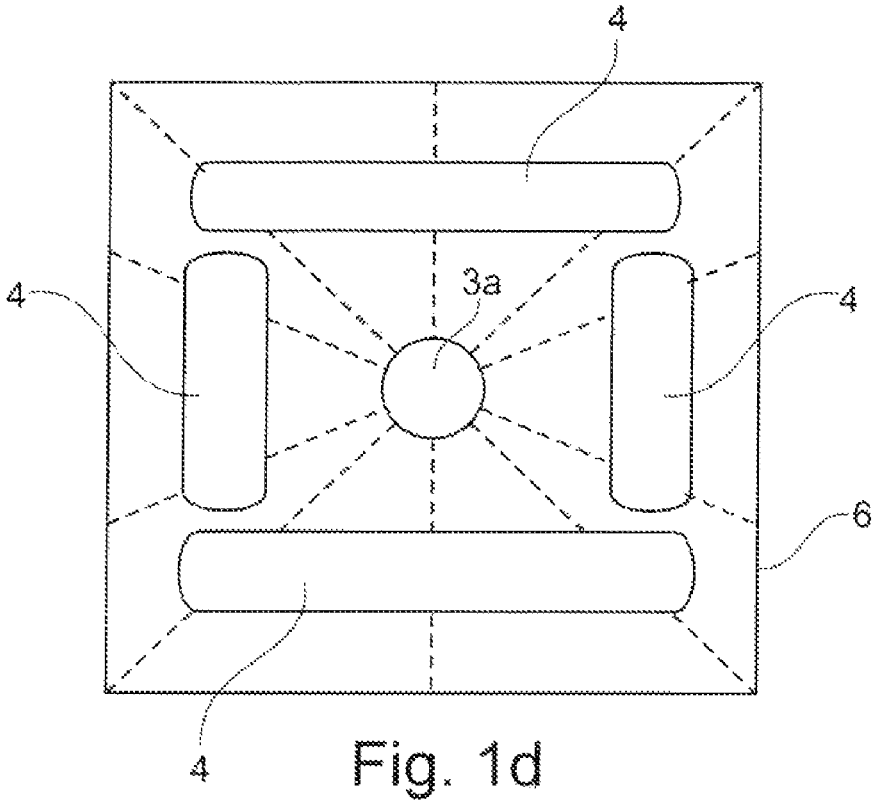
Figure 2:
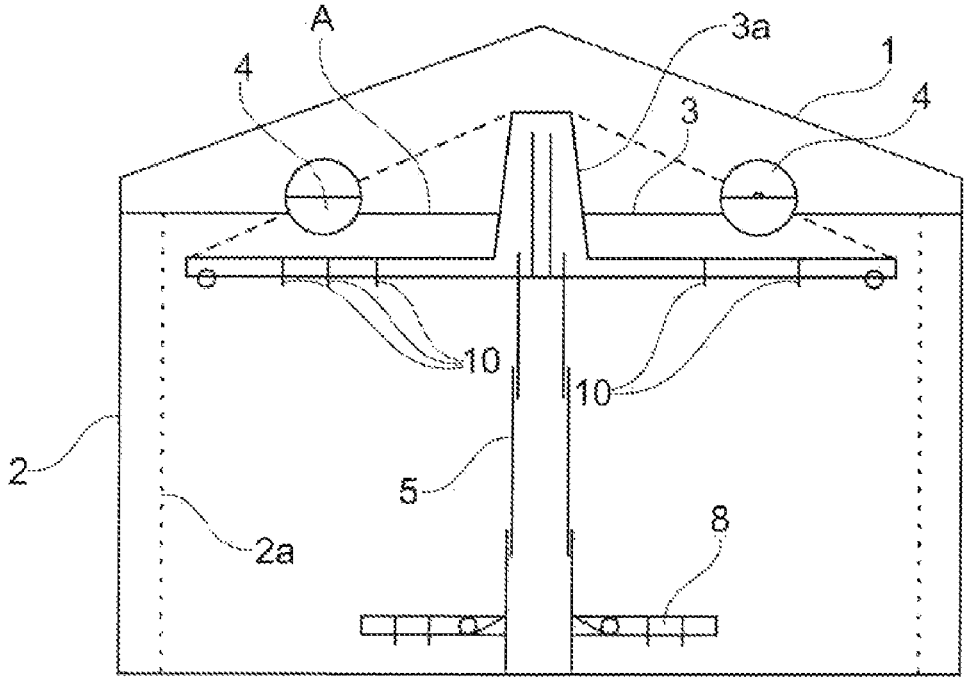
Figure 2A:
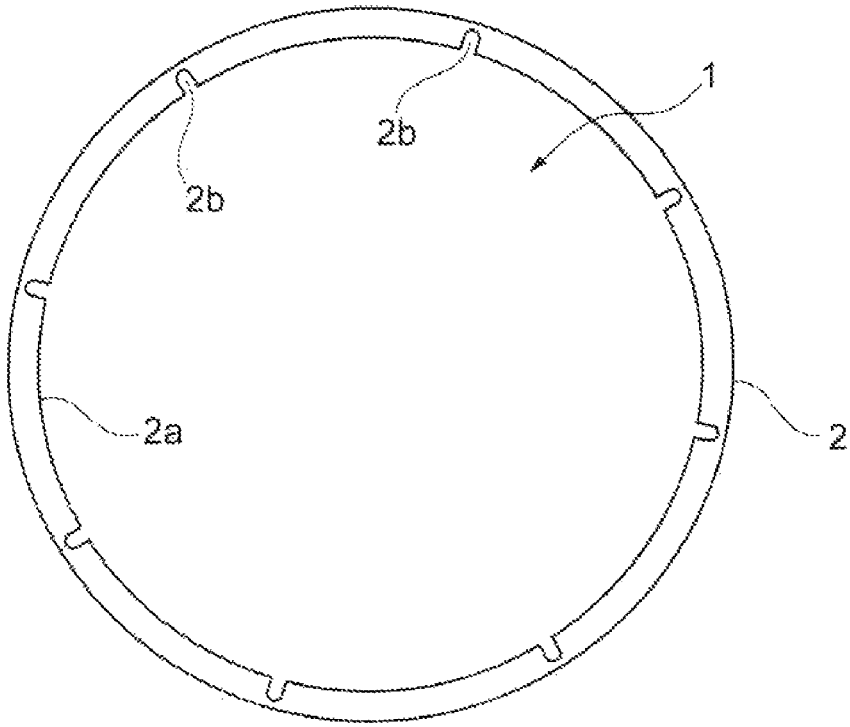
Figure 2B:
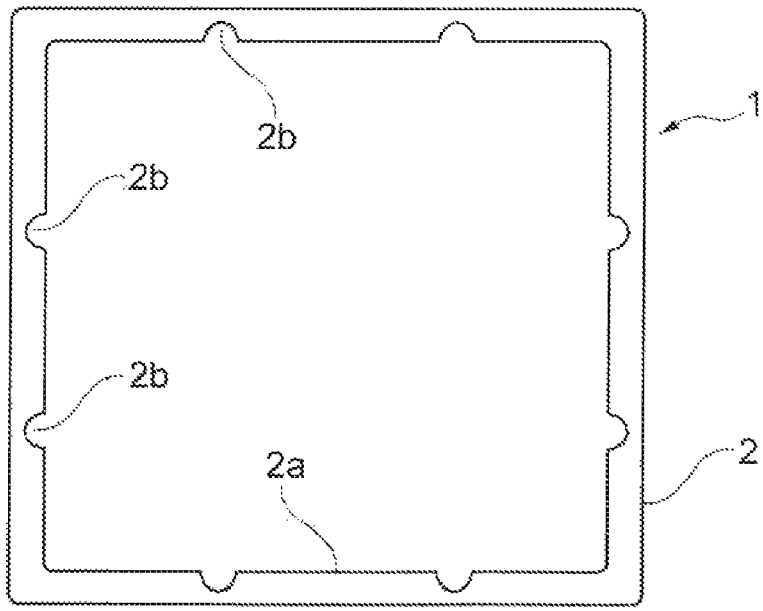
Figure 3:
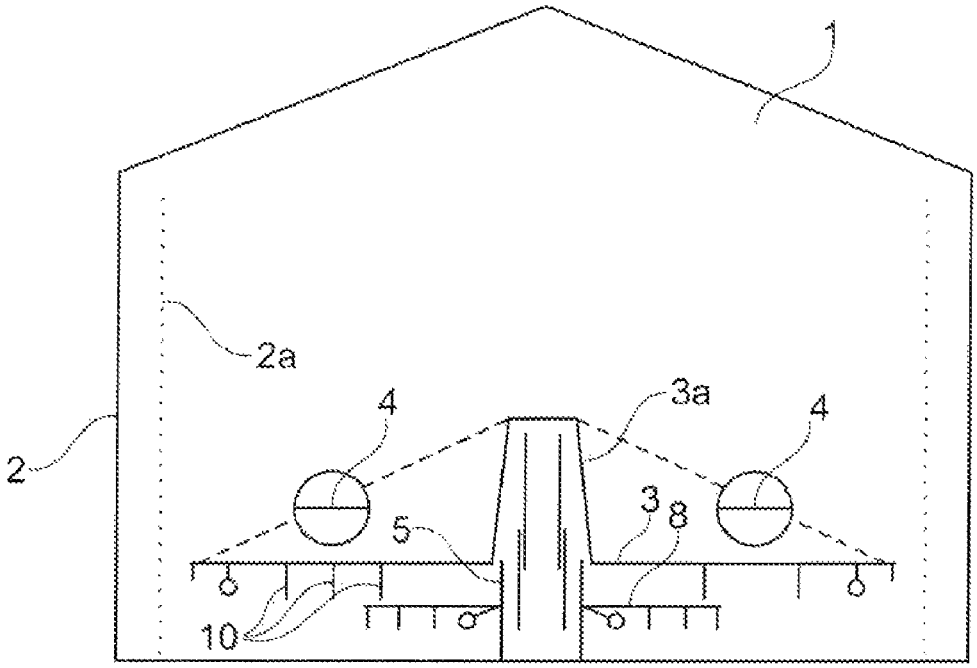
FIG. 3 shows the container shown in FIG. 2 in the almost or entirely emptied state and with retracted telescoping pipe 5.
Figure 4:
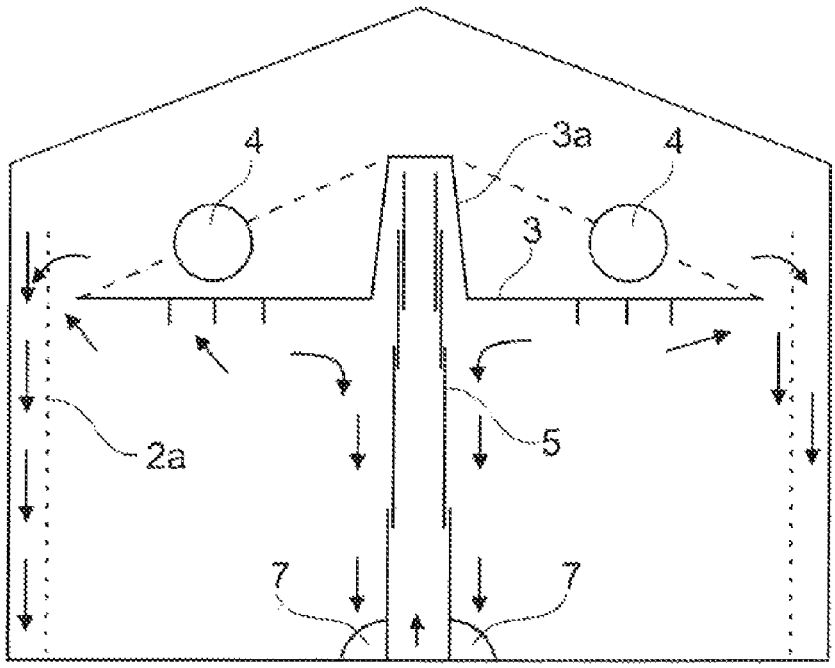
FIG. 4 shows the same container as in FIG. 1 with a central filling and evacuation pipe. A quarter pipe, welded upon the bottom around the telescoping pipe 5, is provided with openings for uniform heat and product distribution.
Figure 5:
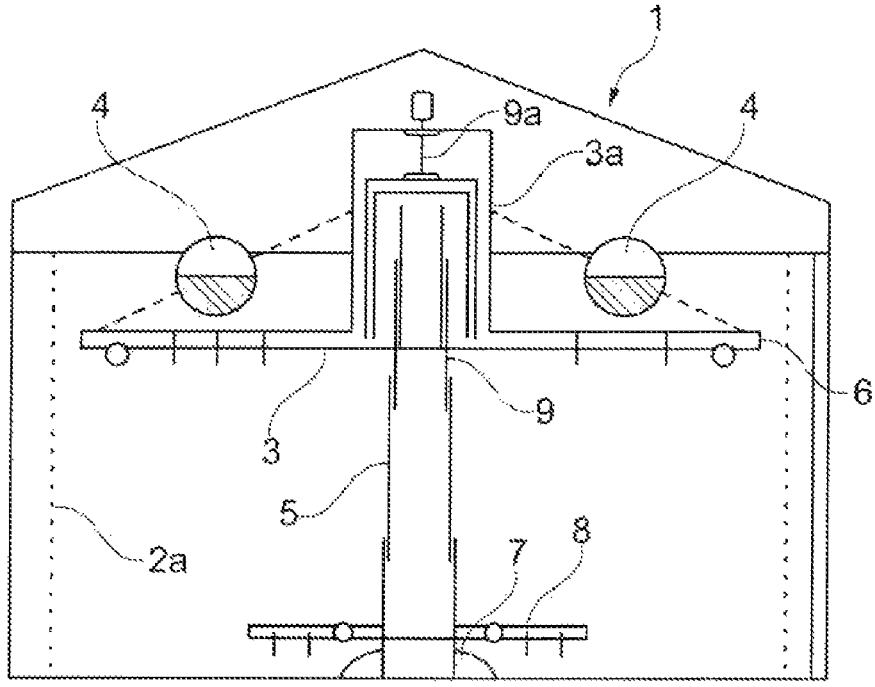
Figure 6:
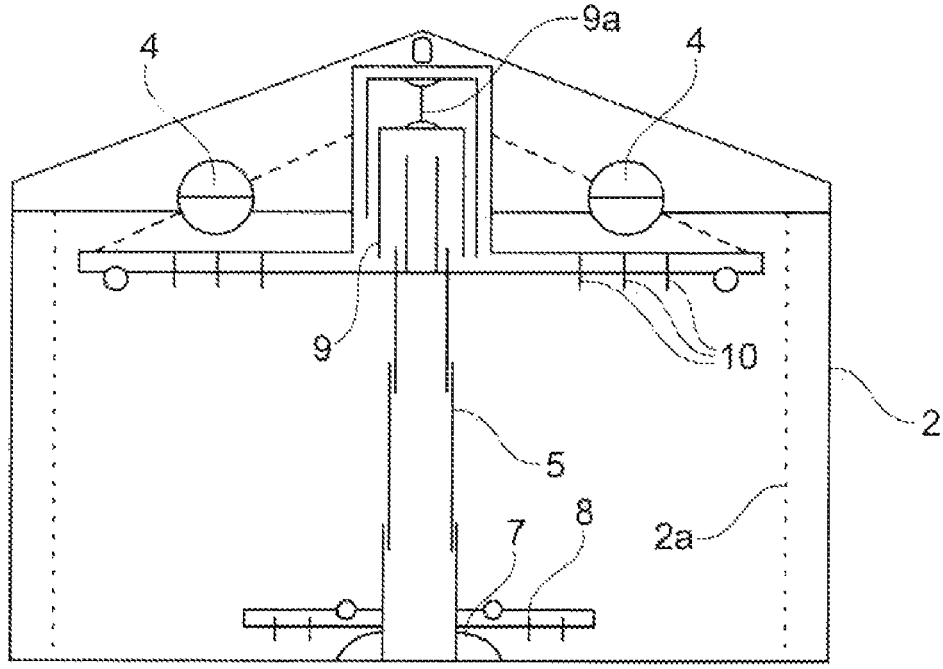

FIGS. 5 and 6 show a container 1, as in FIG. 2 or 3, with an additional distribution accessory 9. The distribution accessory is moved by means of a drive into the particular position determined by the personnel or the process control system.

If, for instance, during the washing phase, the product is colder on one side of the container, then the distribution accessory is lowered and placed in position so that the warmer side will be screened. The rising hot product now presses into the colder regions of the container. The distribution accessory is built into the, this time cylindrical hat 3*a* of melting member 3 and is connected downward with the telescoping pipe 5 via a cylinder. The cylinder ensures uniform supply of the product and protects the superposed parts. The distribution accessory can be guided via perpendicular guide rails and a spindle 9*a*, provided with a drive, located between melting member hat 3*a* and distribution accessory 9. At least two spacing rings and terminal stops 3 provide guidance at all times. A part of the distribution accessory 9 remains in the upper hat-shaped part of the upper melting member 3 to prevent jamming. If the distribution accessory 9 is needed, then it is lowered with spindle 9*a* until the perpendicular guide rails no longer engage each other. Spindle 9*a*, whose height can be adjusted, at its lower end no longer has a thread, only a stop, that continues to turn the distribution accessory 9. Distribution accessory 9 now lies on the terminal stop and is moved into the desired position by the drive in the same direction of rotation. If the distribution accessory 9 is no longer needed, the direction of rotation of the drive is changed. Now, spindle 9*a* sags and the thread engages in order again to pull the distribution accessory 9 upward. The guide rails again engage each other until the drive is shut off.

Figure 7:
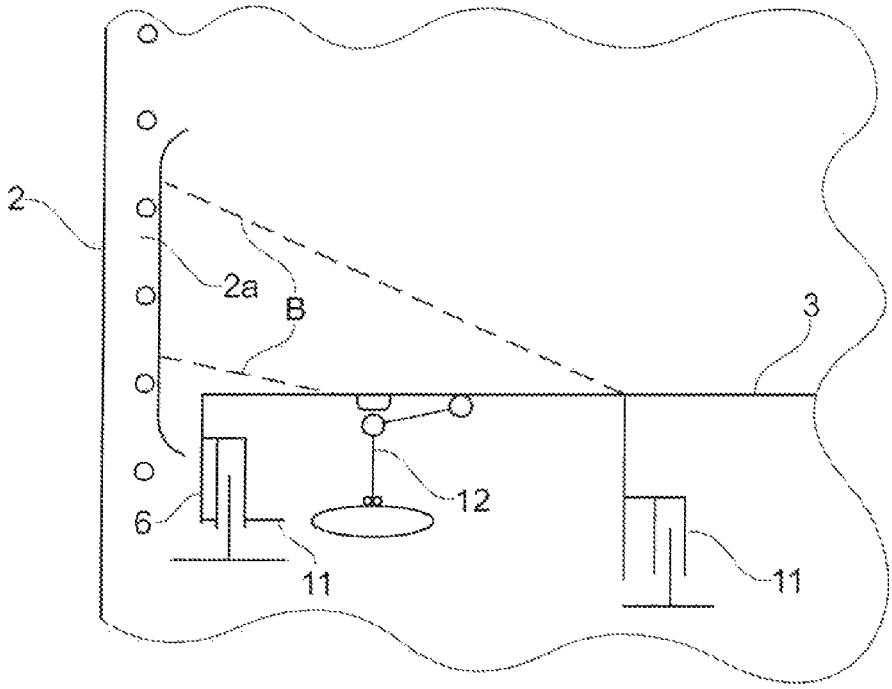

FIG. 7 shows the detail between the outer wall 2 and the melting member 3 (also possible for melting member 8). Using, for instance, a laser measurement process, one can determine whether the upper melting member 3 is in the horizontal position (b). The horizontal position of both melting members 3 and 8 can also be checked with an inclination measurement. Using float 12, one determines whether enough nitrogen is stored. If the plunger of the float is retracted, then one must possibly blow nitrogen in. The float can also be used to determine whether the filling level is equal over the entire cross-section of the container, that is to say, whether the distribution accessory 9 goes into action. Finally, one can also use this procedure to measure whether less product needs to be evacuated out of the container so that the melting member will sink more slowly. Measurement sensors 11 are possibly present furthermore on accessories 10.

Figure 8:
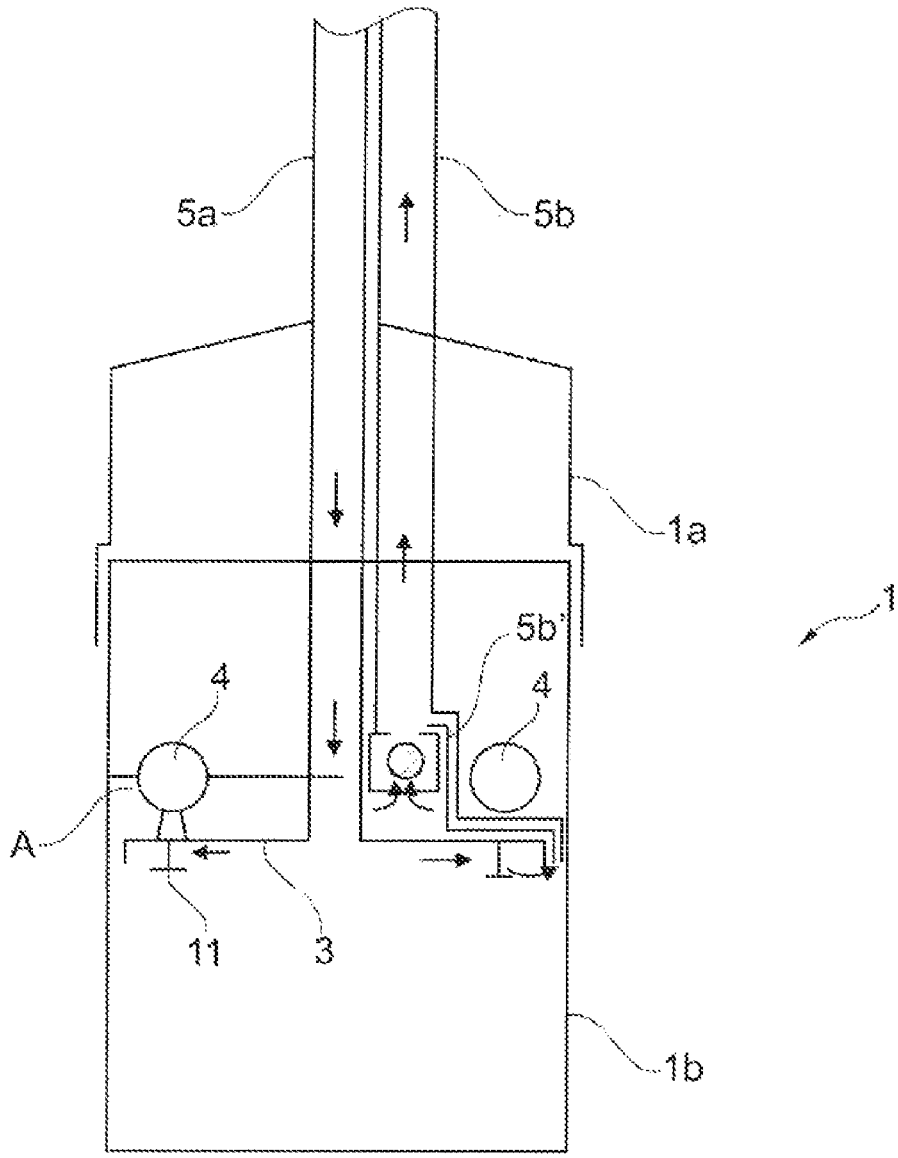

FIG. 8 shows another exemplary embodiment of the invention where the melting member 3—with feed pipe 5*a* and evacuation pipe 5*b*—is attached to a container accessory 1*a*. Container accessory 1*a* is set upon an open barrel 1*b* so that one gets a multipart container 1. The filling level of the stored product is labeled "A." The melting member works as described earlier. The liquefied product is suctioned off in this case through the evacuation pipe 5*b* by suctioning from above. The product is removed first of all around the valve ball that is to be designed in accordance with the weight and the circumference and in case of almost complete evacuation via the accessory suction pipe 5*b*' for the residual evacuation.

The container can generally consist of all suitable materials, in particular metal or synthetics. It can be foldable in the empty state for instance by using flexible synthetics.

LIST OF REFERENCES

1 Container
1*a* Container Accessory
1*b* Base container/barrel
2 Outside wall of container
3 Upper melting member
3*a* Hat
4 Float
5 Feed line in the form of a telescoping pipe
5*a* Feed
5*b* Evacuation
5*b*' Accessory suction pipe
6 Guide rails on upper melting member
7 Filling and Emptying pipe
8 Lower melting member
9 Distribution accessory
10 Guide plate (accessories)
11 Measurement sensor
12 Float

The invention claimed is:

1. A chemical product handling method, comprising the steps of i) feeding the chemical product into the container in a liquid state at a temperature above its melting temperature, wherein in the step of feeding, liquid chemical product is fed into the container via an essentially vertical feeder line made from heat conducting material, and wherein the liquid chemical product is distributed essentially horizontally over a cross section of the container below at least one melting member made from heat conducting material;

and ii) storing the chemical product in the container at a temperature below its melting temperature in an at least partly rigidified state.

2. The method of claim 1, further comprising the steps of blowing the feeder line clear after passages of the liquid chemical product; and filling the feeder line with inert gas until its next use.

3. The method of claim 1, further comprising the steps of blowing a surface below the at least one melting member clear after the passage of liquid chemical product; and filling the surface below the at least one melting member with an inert gas until its next use.

4. The method of claim 1, further comprising the step of adjusting pressure within the container by generating liquid chemical product outside a core of rigidified chemical product stored below the melting temperature, wherein the liquid chemical product is generated via an interior partition heating unit provided on at least one outer wall of the container, and wherein the liquid chemical product is used to melt additional product; and evacuating the additional melted product so as to adjust pressure within the container.

5. The method of claim 1, further comprising the step of keeping a part of the product stored in the container liquid during storage via one or more heating elements.

6. The method of claim 5, wherein said one or more heating elements are selected from the group consisting of an interior partition heating unit, a feeder line heating element and a melting member heating element.

7. The method of claim 1, further comprising the step of removing stored product from the container by melting the at least partly rigidified chemical product using heat from liquid product that is fed into the feeder line, the heat from the liquid product heating the feeder line and the at least one melting member; and removing melted product through an evacuation pipe.

8. The method of claim 7, wherein the step of removing occurs via at least one horizontal flow level below the at least one melting member and vertically along the feeder line.

9. The method of claim 7, wherein the liquid product that is fed into the feeder line during the melting step is from a production facility, or is conveyed in a cycle inside the container, or is conveyed in a cycle via an additional heated accessory container connected with the container.

10. The method of claim 7, wherein the step of melting takes place by way of one or both of progressing liquefaction from top to bottom and progressing liquefaction from bottom to top while the at least one melting members is moved accordingly.

11. A device for the storage of chemical products that have a melting point below the storage temperature range, comprising an undivided or multipart container;

a feeder line which consists of heat conducting material and which extends essentially vertically inside the container, wherein the feed line is suitable for conducting liquid and gas;

at least one melting member which consists of heat conducting material and which extends horizontally over a cross section of the container and is arranged around the feeder line; and at least one outlet.

12. The device of claim 11, wherein the melting member is movable along the feeder line.

13. The device of claim 11, wherein the feeder line is a telescoping pipe.

14. The device of claim 11, wherein the at least one melting member comprises an upper melting member and a lower melting member.

15. The device of claim 14, wherein the upper melting member has a hat-like shape and is arranged at an end of the feeder line.

16. The device of claim 14, wherein the upper melting member is in the shape of a ring.

17. The device of claim 14, wherein the upper melting member is equipped with floats.

18. The device of claim 11, wherein the at least one melting member has downward pointing accessories that generate flow resistance.

19. The device of claim 11, wherein the container has at least one internal heating unit.

20. The device of claim 11, further comprising an asymmetrical distribution accessory associated with the at least one outlet.

21. The device of claim 20, wherein the asymmetrical distribution accessory is a guide plate whose position can be altered to give the liquid chemical product a preferred direction of distribution during insertion for storage and removal from storage.

* * * * *